US010264353B2

(12) United States Patent
Bini et al.

(10) Patent No.: US 10,264,353 B2
(45) Date of Patent: Apr. 16, 2019

(54) METHOD OF PROCESSING DIGITAL SIGNALS, IN PARTICULAR DIGITAL ACOUSTIC SIGNALS, BY SAMPLE SKIPPING AND DECIMATION FILTERING AND CORRESPONDING DEVICE

(71) Applicants: STMicroelectronics (Rousset) SAS, Rousset (FR); STMicroelectronics Design and Application S.R.O., Prague (CZ); STMicroelectronics (Alps) SAS, Grenoble (FR)

(72) Inventors: Jean Claude Bini, Vence (FR); Dragos Davidescu, Lambesc (FR); Igor Cesko, Prague (CZ); Jonathan Cottinet, Bourgoin Jallieu (FR)

(73) Assignees: STMicroelectronics (Rousset) SAS, Rousset (FR); STMicroelectronics Design and Application S.R.O., Prague (CZ); STMicroelectronics (Alps) SAS, Grenoble (FR)

( * ) Notice: Subject to any disclaimer, the term of this patent is extended or adjusted under 35 U.S.C. 154(b) by 0 days.

(21) Appl. No.: 15/473,812

(22) Filed: Mar. 30, 2017

(65) Prior Publication Data

US 2018/0063638 A1 Mar. 1, 2018

(30) Foreign Application Priority Data

Aug. 23, 2016 (FR) ..... 16 57854

(51) Int. Cl.
*H04R 3/00* (2006.01)
*H04R 3/04* (2006.01)
(Continued)

(52) U.S. Cl.
CPC ..... *H04R 3/005* (2013.01); *G10K 11/346* (2013.01); *H04R 3/04* (2013.01); *H04R 1/406* (2013.01);
(Continued)

(58) Field of Classification Search
None
See application file for complete search history.

(56) References Cited

U.S. PATENT DOCUMENTS 6,680,753 B2 * 1/2004 Kahn ..... G10L 21/01 348/512
2005/0184890 A1 * 8/2005 Avantaggiati ..... H03H 17/0621 341/61
(Continued)

FOREIGN PATENT DOCUMENTS

EP 1744174 A1 1/2007
WO WO-9423422 A1 10/1994

OTHER PUBLICATIONS

Barry D. Van Veen and Kevin M. Buckley, "Beamforming: A versatile approach to spatial filtering" IEEE ASSP Magazine, Apr. 1988, pp. 4-24.
(Continued)

*Primary Examiner* — James K Mooney
(74) *Attorney, Agent, or Firm* — Crowe & Dunlevy

(57) ABSTRACT

Several first digital streams of first digital samples at a first sampling frequency are processed to issue corresponding stream that are converted into second digital streams sampled at a second sampling frequency lower than said first sampling frequency. At least one delay to be applied to at least one first digital stream to satisfy a condition on the second digital streams is determined and applied to at least one first digital stream before converting. The converting operation performed is decimation filtering of the first digital streams. The application of the at least one delay to at least
(Continued)

one first steam involves skipping a number of first digital samples in the at least one first digital stream. The number skipped depends on the value of the at least one delay. Samples that are skipped are not delivered for decimation filtering.

15 Claims, 4 Drawing Sheets

(51) Int. Cl.
*G10K 11/34* (2006.01)
*H04R 1/40* (2006.01)
*H04R 19/00* (2006.01)

(52) U.S. Cl.
CPC ..... *H04R 19/005* (2013.01); *H04R 2201/003* (2013.01); *H04R 2430/23* (2013.01)

(56) References Cited

U.S. PATENT DOCUMENTS

2012/0188058 A1* 7/2012 Lee ..... G06K 7/10356 340/10.1
2018/0034470 A1* 2/2018 Fan ..... H04B 7/0617

OTHER PUBLICATIONS

INPI Search Report and Written Opinion for FR 1657854 dated Apr. 19, 2017 (7 pages).

* cited by examiner

METHOD OF PROCESSING DIGITAL SIGNALS, IN PARTICULAR DIGITAL ACOUSTIC SIGNALS, BY SAMPLE SKIPPING AND DECIMATION FILTERING AND CORRESPONDING DEVICE

PRIORITY CLAIM

This application claims the priority benefit of French Application for Patent No. 1657854, filed on Aug. 23, 2016, the disclosure of which is hereby incorporated by reference in its entirety.

TECHNICAL FIELD

Embodiments relate to the processing of signals representative of physical entities, for example, but not restrictively, acoustic signals issued from several microphones, such as MEMS (Micro ElectroMechanical System) microphones.

Non limiting applications comprise audio applications with several microphones (for instance beamforming, which is a method for discriminating between different signals based on the physical location of the different signals sources).

Other applications may also use location of source signals, such as ultra-sound detection for gesture recognition.

BACKGROUND

MEMS microphones normally comprise a membrane that defines an electrode of a capacitor. When the membrane undergoes deformation in response to an acoustic signal, the capacitance of the capacitor varies, and the capacitance variations may be read and converted into an output signal indicating the amplitude of the acoustic signal.

MEMS microphones are then provided with read interfaces, which generally supply electrical output signals in PDM (pulse-density modulation) format, i.e., a series of high-frequency pulses (typically from few hundreds of kHz to few MHz), the temporal density of which indicates the amplitude of the input signal. The electrical signals are then supplied to a processing unit for carrying out conversion into PCM (pulse-code modulation) format, which is the encoding commonly used for audio signals.

The high-frequency signals in PDM format enable one to obtain high-precision signals in PCM format.

MEMS microphones have proven particularly interesting, among other things, for applications in which arrays of microphones are used. In these cases, the signals supplied by the individual microphones are collected by a single processing unit, which, in addition to carrying out conversion into PCM format, may combine and further process the signals received. In particular, it is possible to implement so-called beamforming algorithms, i.e., spatial filtering techniques that enable selective amplification of the acoustic signals coming from a given direction, while attenuating the other contributions. Beamforming algorithms are frequently used when directionality is important for improving the quality of reception, for example in the case of music recording, voice recognition, teleconference applications, web-conferencing, and so forth.

In other words, beamforming is a method for discriminating between different signals based on the physical location of the sources of those different signals and beamforming enables creation of a virtual microphone pointing to a preferred direction using an array of microphones.

Beamforming is generally performed by software and uses audio PCM flow.

If the direction intended to be privileged is 0°, 90° or 180°, the delay to apply to one of the microphone is an integer value of 1/F where F the PCM sampling frequency. In all other cases the delay is a fractional value of 1/F.

However, generally, because the PCM frequency is comprised between 4 kHz and 48 kHz, typically equal to 16 kHz, it is difficult to keep such distance between microphones in an apparatus, such as a smartphone for example.

Thus, when the distance between microphones is smaller than C/F (where C is the speed of sound in air: ≈340 m/s), it is required to tune delays of microphones signals to emulate static or dynamic placement of the microphones.

A conventional solution for implementing those delays consists in using delay lines.

The size of these delay lines, i.e. the numbers of delay cells, may be important, in particular if a fine tuning of a large number of microphone paths with fine steps is required, leading thus to a great surface on silicon.

Further, the delay depths, i.e. the number of delay cells, must be fixed by hardware during the design phase and is actually designed for the worst case, leading thus to a number of delay cells which is unnecessarily great in other cases.

There is accordingly a need for a new solution for implementing those delays in a manner which is less area consuming.

SUMMARY

According to an embodiment it is proposed to have a delay depth that is not dependent on the hardware.

According to an embodiment it is proposed to be more flexible on the delay values.

Thus, according to an aspect, a method of processing signals is proposed comprising: receiving several first streams of first digital samples at a first sampling frequency, for example a PDM frequency, respectively issued from several initial signals representative of physical entities, for example acoustic signals, converting streams issued from the first streams into second digital streams sampled at a second sampling frequency, for example a PCM frequency, lower than said first sampling frequency, (a stream issued from a first stream may be a delayed first stream or the first stream itself if it is not delayed); determining at least one delay to be applied to at least one first stream to satisfy a condition on said sequence streams, for example an alignment of said audio signals in accordance with a beamforming algorithm, and applying said at least one delay to said at least one first stream before converting. Converting comprises filtering said several first streams into respective several decimation filters. Applying said at least one delay to said at least one first stream comprises skipping a number of first samples in said at least one first stream, said number depending on the value of said at least one delay, said skipped first samples being not delivered to the corresponding decimation filter.

In other words, the delay tuning is performed by a sample(s) skipping technique instead of using conventional delay lines. And, the combination of the decimation filter properties with this sample(s) skipping contributes to perform delays without the need of delay lines. As a matter of fact, skipping some samples at the input of a decimation filter does not lead to a perceptible quality reduction in the final signal resulting from this processing, i.e., for example, the final audio signal delivered by the virtual microphone built by a beamforming algorithm and pointing at preferred location from an array of microphones.

Further, in particular but not exclusively for an audio application, thanks to the delaying of the digital streams upstream of the conversion stage, for example a PDM to PCM conversion stage, the execution of beamforming algorithms may be reduced substantially to "sums between integers" (i.e. a recombining step) performed by a processor for example, while temporal translations are performed by skipping a corresponding number of samples, which entail extremely low consumption in terms both of time and of energy. In particular, it is possible to exploit the high PDM sampling frequency for producing exact and properly aligned samples in order to set the preferential direction of reception without any interpolations.

Each decimation filter is clocked by a first clock signal having a frequency which may be equal to or greater than said first sampling frequency (for example the PDM frequency). But whatever the frequency of the first clock signal, skipping said number of first samples in said at least one first stream comprises skipping said number of clock cycles in the clock signal having said first sampling frequency (for example the PDM clock).

However, if the first clock signal clocking each decimation filter has a frequency equal to the first sampling frequency (for example, the PDM frequency), the skipped pulses are advantageously the pulses of the first clock signal.

In other words, according to an embodiment, each decimation filter is clocked by a first clock signal having said first sampling frequency and skipping said number of first samples in said at least one first stream comprises skipping said number of clock cycles in the corresponding first clock signal clocking said corresponding decimation filter associated to said at least one first stream.

Skipping said number of clock cycles in said corresponding said first clock signal may comprise gating said corresponding first clock signal.

According to a particular embodiment, said initial signals are acoustic signals, said first streams of first digital samples are in Pulse Density Modulation (PDM) format, said second digital streams are audio signals in Pulse Code Modulation (PCM) format and the satisfaction of said condition is an alignment of said audio signals in accordance with a beamforming algorithm.

According to another aspect, a device is proposed comprising: an input configured to receive several first streams of first digital samples at a first sampling frequency respectively issued from several initial signals representative of physical entities, a conversion stage configured to convert streams issued from the first streams into second digital streams sampled at a second sampling frequency lower than said first sampling frequency, a control or processing unit configured to determine at least one delay to be applied to at least one first stream to satisfy a condition on said second streams, and a delay stage, coupled between said input means and said conversion stage, and configured to apply said at least one delay to said at least one first stream. The conversion stage comprises several decimation filters respectively associated to said several first streams. The delay stage comprises several skipping modules respectively configured to skip numbers of first samples of the first streams in response to several control information (for one or more first streams the corresponding number of first samples to skip may be null). The control unit is configured to deliver at least one control information to said at least one skipping module associated to said at least one first stream, said control information including the value of the number of first samples to skip, the value of said number depending on the value of said at least one delay, said skipped first samples being not delivered to the corresponding decimation filter.

Each control information may further comprise a trigger signal.

According to an embodiment, each decimation filter is clocked by a first clock signal having said first sampling frequency and each skipping module is configured to skip said number of clock cycles in the corresponding first clock signal clocking said corresponding decimation filter associated to said at least one first stream.

According to an embodiment, each skipping module comprises a gating circuit configured to receive said first clock signal and said control information and to deliver a gated first clock signal to the corresponding decimation filter.

According to an embodiment, said gating circuit comprises: a counter configured to be clocked by said first clock signal, to be controlled by said trigger signal, to receive said number value and to deliver a control gate signal having a first logic value when the trigger signal has a value corresponding to a non-skipping mode, and a second logic value when the trigger signal has a value corresponding to a skipping mode and until the counter has counted a number of first clock cycles equal to the number of first samples to skip, and a logic gate configured to receive said first clock signal and said control gate signal and to deliver said gated first clock signal having no clock pulses when said control gate signal has said second logic value.

According to an embodiment, the device may comprise: a microprocessor or a microcontroller incorporating said control or processing unit implemented by software, and hardware glue around said microprocessor or microcontroller incorporating said decimation filters.

Accordingly, this embodiment permit to use existing hardware glue around a microcontroller or a microprocessor for implementing the decimation filters.

According to an embodiment, said initial signals are acoustic signals, said first streams of first digital samples are in Pulse Density Modulation (PDM) format, said second digital streams are audio signals in Pulse Code Modulation (PCM) format and the satisfaction of said condition is an alignment of said audio signals in accordance with a beam forming algorithm implemented in said control unit.

It should be however noted that the first stream can be something different from a signal provided from a microphone. It could be a signal delivered by any kind of analog to digital converter, in which a decimation filter is needed to slow-down the data rate.

According to an embodiment, the device may further comprise an array of digital microphones coupled to said input and configured to supply said first streams in response to said acoustic signals.

Although any types of microphones may be used, such as digital microphones or analog microphones combined with analog to digital converters, it is particularly advantageous to use MEMS (Micro ElectroMechanical Systems) microphones.

According to another aspect, an apparatus is proposed incorporating a device as defined above.

Such apparatus may belong to the group formed by a phone, a smartphone, a tablet, a phablet, a wearable device, a plugged system such as a conference phone, these examples being in no way limiting.

BRIEF DESCRIPTION OF THE DRAWINGS

Other advantages and features of the invention will appear in the detailed description below and in the appended drawings which are not limitative, wherein.

DETAILED DESCRIPTION

Figure 1:
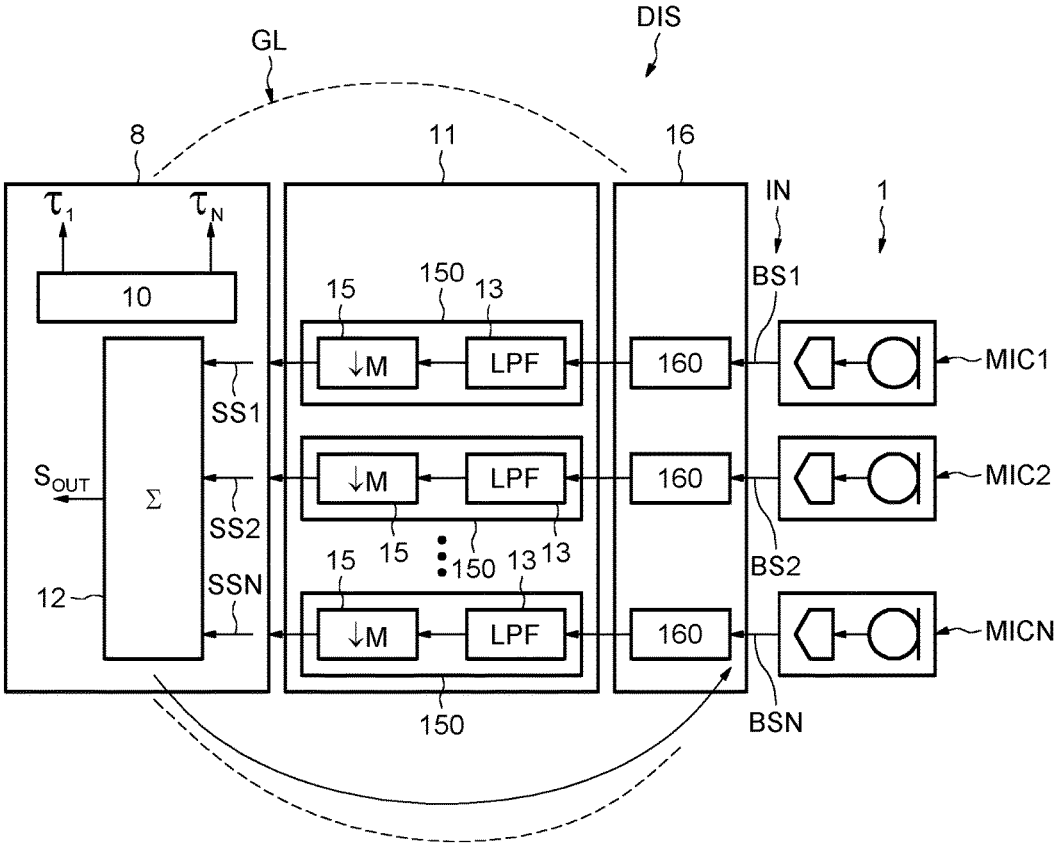
FIG. 1 is a block diagram of a device.

With reference to FIG. 1, the device DIS comprises an input IN for receiving N first digital streams provided here by an array of microphones designated as a whole by the reference number 1 and including a plurality of digital MEMS microphones MIC1-MICN (N being equal or greater than 2, preferably greater than 2), and a control or processing unit 8.

In one embodiment, the digital microphones MICi are aligned in one direction for forming a one-dimensional array and are set at a distance from one another for example, but not necessarily, in a uniform way. In particular, adjacent digital microphones are separated by a uniform distance D.

Figure 2:
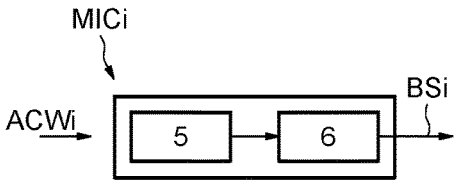
FIG. 2 is a block diagram of a digital MEMS microphone.

As illustrated in FIG. 2, each digital microphone MICi is a MEMS type microphone and comprises a microelectromechanical electro-acoustic transducer 5, for example of a membrane capacitive type, and a converter 6. A sensing electrical property of the electro-acoustic transducer 5 (for example, the capacitance of a capacitor, of which the membrane, not illustrated, forms an electrode) is modified in response to the interaction with an incident acoustic wave ACWi. The converter 6 reads the variations of the sensing electrical property and produces the oversampled digital first bitstream BSi (for the generic i-th digital microphone MICi) in PDM format.

In one embodiment, in particular, the converter 6 is a sigma-delta converter, and the first bitstream BSi supplied has a sampling frequency $F_{PDM}$ comprised between few hundreds of Khz and few MHz and a corresponding sampling period $\tau_{PDM}$.

The processing unit 8 is here an integrated processor 8, which may for example be a general-purpose microprocessor or a digital-signal processor (DSP). The processing unit 8 is configured to apply a beamforming algorithm to the signals received from the digital microphones MICi for enabling selection of a preferential direction of reception.

A beamforming algorithm is an algorithm well known by those skilled in the art. See, for example, the article of Barry D. Van Veen and Kevin M. Buckley, "Beamforming: A versatile approach to spatial filtering" IEEE ASSP MAGAZINE, April 1988, which gives information on the beamforming technique and references of beamforming algorithms.

Further to the processing unit 8, the device DIS comprises a delay stage 16 and a conversion stage 11, here a PDM to PCM conversion stage 11.

As it will be explained more in detail thereafter, the delay stage 16 comprises N skipping modules 160 respectively associated to the N first bitstreams BSi and configured to skip numbers of samples of the first bitstreams BSi in response to several respective control information. Of course depending on the case, one or more numbers may be equal to zero (i.e., there is no skip of a sample).

The number of samples to skip in the first stream BSi is related to the value of the delay $\tau_i$ to apply to the said first stream. And as indicated above one or more delays may be null.

The relations between the delays $\tau_1, \tau_2, \ldots, \tau_N$ are determined by the integrated processor 8 in the form of numbers of PDM samples, as explained in detail hereinafter. In practice, the delays $\tau_1, \tau_2, \ldots, \tau_N$ may be multiples of the sampling period $\tau_{PDM}$.

The integrated processor 8 comprises a computing module 10, which determines (in a dynamic case) and sets the delays $\tau_1, \tau_2, \ldots, \tau_N$ and a re-combiner module 12.

Those delays may be defined by the user in a static case.

The PDM-to-PCM conversion stage 11 receives respective delayed bitstreams in PDM format and supplies respective second digital streams, which represent here audio signals, SS1, SS2, . . . , SSN by conversion into PCM format, which is normally used for encoding digital audio signals. The audio signals SS1, SS2, . . . , SSN may be represented, for example, by 16-bit integers with a sampling frequency $F_{PCM}$ comprised between 4 kHz and 48 kHz and corresponding sampling period $\tau_{PCM}$.

The PDM-to-PCM conversion stage 11 comprises N decimation filters 150 respectively associated to the N microphones. Each decimation filter comprises a lowpass filter 13 and a decimator 15. The lowpass filter 13 removes the high frequency components from the received, eventually delayed, bitstream, and the decimator 15 eliminates the redundant samples with a decimation factor M equal to $F_{PDM}/F_{PCM}$ given by the ratio between the sampling frequency $F_{PDM}$ of the signals in PDM format and the sampling frequency $F_{PCM}$ of the signals in PCM format.

Hardware glue GL around said microprocessor 8 can be advantageously used for incorporating said decimation filters.

The audio streams SS1, SS2, . . . , SSN are supplied to the re-combiner module 12, where microphone mismatches are compensated and signals added to form a synthetic audio signal SOUT.

In the synthetic audio signal SOUT, the contributions received from all the digital microphones and due to the acoustic signals coming from a preferential direction of reception selected are added coherently and then amplified, unlike the contributions coming from different directions.

In some beamforming algorithms, selection of the preferential direction of reception is obtained by applying of the delays $\tau_1, \tau_2, \ldots, \tau_N$ by compensating various impairments and by summing the audio signals SS1, SS2, . . . , SSN, respectively.

However, other variants may exist. For example, the axis is given by the axis formed physically by 2 microphones and the direction is chosen by the beamforming algorithm when it is decided which microphone is to be used as front microphone. And the delays permit to align the microphone with PCM frequency. Such a way of aligning to PCM frequency is of course useful for beamforming but also in other applications.

As it is well known by those skilled in the art, a same wave front of an acoustic signal, which travels with a speed C (C being the speed of sound in air, i.e., approximately 340 m/s) in a direction of propagation inclined by an angle θ with respect to the normal to the alignment direction of the digital microphones, reaches the digital microphones themselves at successive instants t1, t2, . . . , tK, which for the generic i-th element of the array of microphones are given by $$ti=t1+(i-1)\tau \qquad \text{Eq. 1}$$

where $\tau=(D/C)\sin\theta$ and $1\leq i\leq N$.

In order to select a preferential direction of reception, corresponding, for example, to the angle θ, the computing module 10 determines the delays $\tau_1, \tau_2, \ldots, \tau_N$ for each microphone, for example using Eq. 1, so that the adder module 12 adds samples that correspond to a same wave-front travelling in the direction of propagation identified by the angle θ.

In particular, the generic delay $\tau_1$ for the i-th digital microphone MICi is an integer given by $$\tau_i=[(K-i)\tau/\tau_{PDM}] \quad \text{Eq. 2}$$

where the operator [ ] indicates the integer-part function, and $\tau_{PDM}$, equal to $1/F_{PDM}$ is the PDM sampling period.

In practice, the delays $\tau_1, \tau_2, \ldots, \tau_N$ indicate the number of PDM samples of which the first bitstreams BS1, BS2, . . . , BSK are to be translated so that the samples of the audio signals SS1, SS2, . . . , SSN added in the adder module will correspond to reception of a same wave front travelling in the direction of propagation defined by the angle θ. In other words, with the delays $\tau_1, \tau_2, \ldots, \tau_N$ thus set, the direction of propagation is selected as preferential direction of reception. It is to be noted that, as they are defined here, the delays $\tau_1, \tau_2, \ldots, \tau_N$ are integers. The corresponding effective durations are given by $\tau_1\tau_{PDM}$, $\tau_2\tau_{PDM}, \ldots, \tau_N\tau_{PDM}$.

In principle, the preferential direction of reception is determined exactly only if the delays $\tau_1, \tau_2, \ldots, \tau_N$ are integer multiples of the sampling period $\tau_{PDM}$. However, the sampling frequency $F_{PDM}$ at which the samples of the first bitstreams BS1, BS2, . . . , BSN are produced is sufficiently high to make the error committed using the approximation to the nearest sample (for example, according to Eq. 2) altogether negligible.

In effect, therefore, the introduction of the delays $\tau_1, \tau_2, \ldots, \tau_N$ prior to conversion from the PDM format to the PCM format enables application of beamforming algorithms with satisfactory angular precision and resolution, without interpolations.

In some embodiments, it may be advantageous to carry out the PDM-to-PCM conversion in two or more stages, e.g., for reasons of optimization of the procedures or of acoustics. In these cases, a plurality of lowpass filters and decimators are present, each of which performs a partial decimation. The product of the partial decimation factors is equal to the global decimation factor, which is determined by the ratio between the PDM sampling frequency and the PCM sampling frequency.

Figure 3:
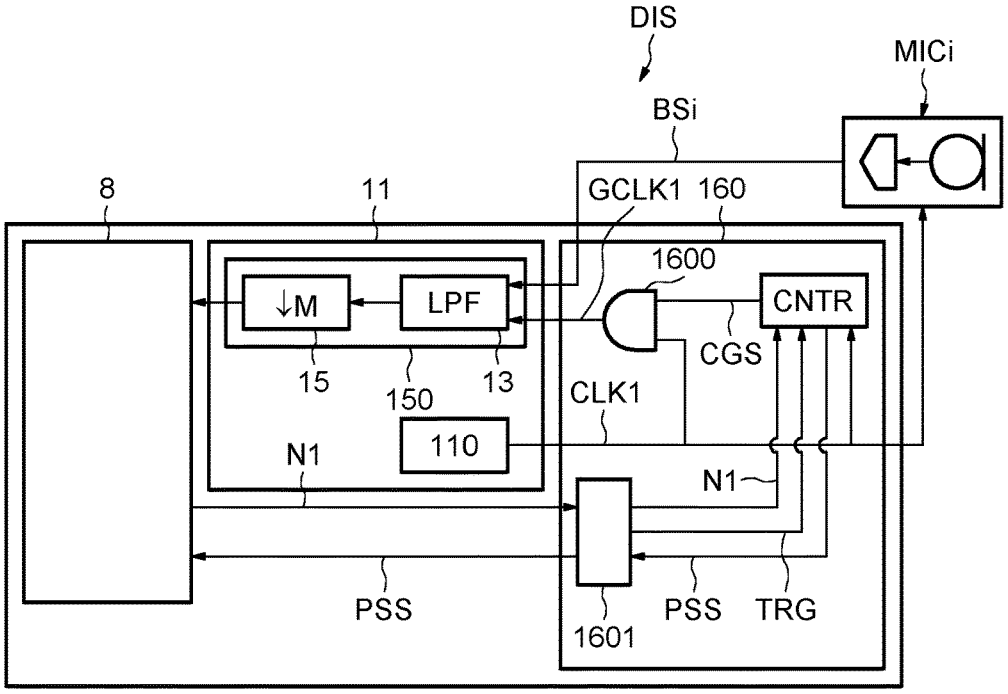
FIG. 3 shows an embodiment of a skipping module.

We refer now more particularly to FIG. 3, which illustrates more in details an embodiment of a skipping module 160.

Generally speaking, the decimation filter 11 as well as the associated digital microphone MICi are clocked by a first clock signal CLK1 having the first sampling frequency $F_{PDM}$. This first clock signal is generated by a clock generator 110 located here within the conversion stage 11. The skipping module 160 is configured to skip a number of first samples in the first stream BSi in response to a control information delivered by the processing or control unit 8.

The control information indicates a value of the number N1 of the first samples to skip, this value of the number N1 depending on the value of the delay $\tau_i$ to apply to the corresponding first stream BSi.

And, the skipped first samples are not delivered to the corresponding decimation filter 150.

More precisely, while as indicated above, the decimation filter is clocked by a first clock signal CLK1 having the sampling frequency $F_{PDM}$, the skipping module is configured to skip a number of clock cycle in the first clock signal CLK1, the number of clock cycles to skip corresponding to the number N1 of samples to skip.

The control information may also comprise a trigger signal TRG.

And, as illustrated on FIG. 3, the skipping module 160 comprises advantageously a gating circuit configured to receive the first clock signal CLK1 and the control information N1 and to deliver a gated first clock signal GCLK1 to the decimation filter 150.

As it can be seen on FIG. 3, the gating circuit comprises an interface 1601 coupled to the processing unit 8 and configured to receive the number N1 and to deliver this number N1, as well as the trigger signal to a counter CNTR. As a variant, the trigger signal could be also delivered by the processing unit 8 to the counter through the interface 1601.

The counter is clocked by the first clock signal CLK1 and is controlled by the trigger signal TRG.

The counter also receives the number N1 and the counter delivers a control gate signal CGS.

This control gate signal CGS has a first logic value for example a logic value equal to 1, corresponding to a non skipping mode.

The control gate signal CGS has also a second logic value, for example the logic value "0", when the trigger signal has a value corresponding to a skipping mode (TRG=1 for example) and until the counter has counted a number of first clock cycles equal to the number N1 of first samples to skip.

The gating circuit also comprises a logic gate, here an AND gate, 1600 configured to receive the first clock signal CLK1 and the control gate signal CGS, and to deliver said gated first clock GCLK1 which has no clock pulses when the control gate signal CGS has the second logic value ("0" for example).

Figure 4:
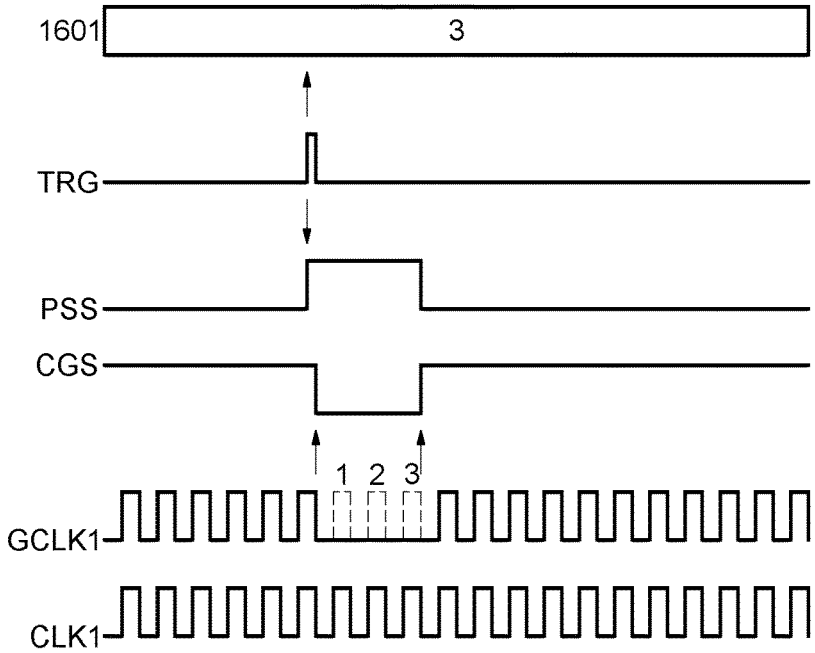
FIG. 4 illustrates timing of operational signals.

An example of those signals is illustrated on FIG. 4 in the case the number N1 of samples to skip in a bitstream is equal to 3.

When the trigger circuit TRG has the logical value equal to 1, the control gate signal CGS takes value 0 during three clock cycles of the first clock signal CLK1, forbidding three samples of the corresponding bitstream BSi to enter into the decimation filter 150.

In this embodiment, the interface 1601 provides also a status signal PSS to the control unit 8 indicating whether or not the skipping mode is finished.

And, the control unit 8 is assumed to check there is no pending skipping mode before starting another skipping mode.

Figure 5:
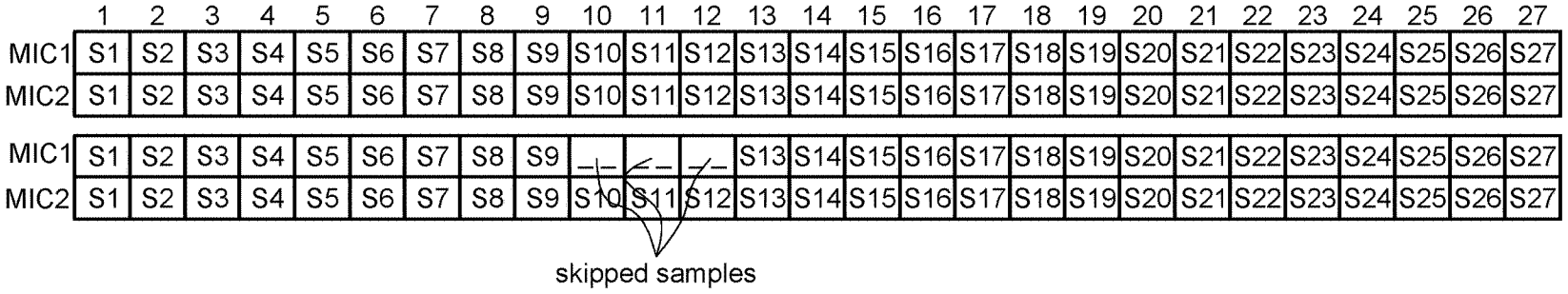
FIGS. 5-6 illustrate a method of operation.
Figure 6:
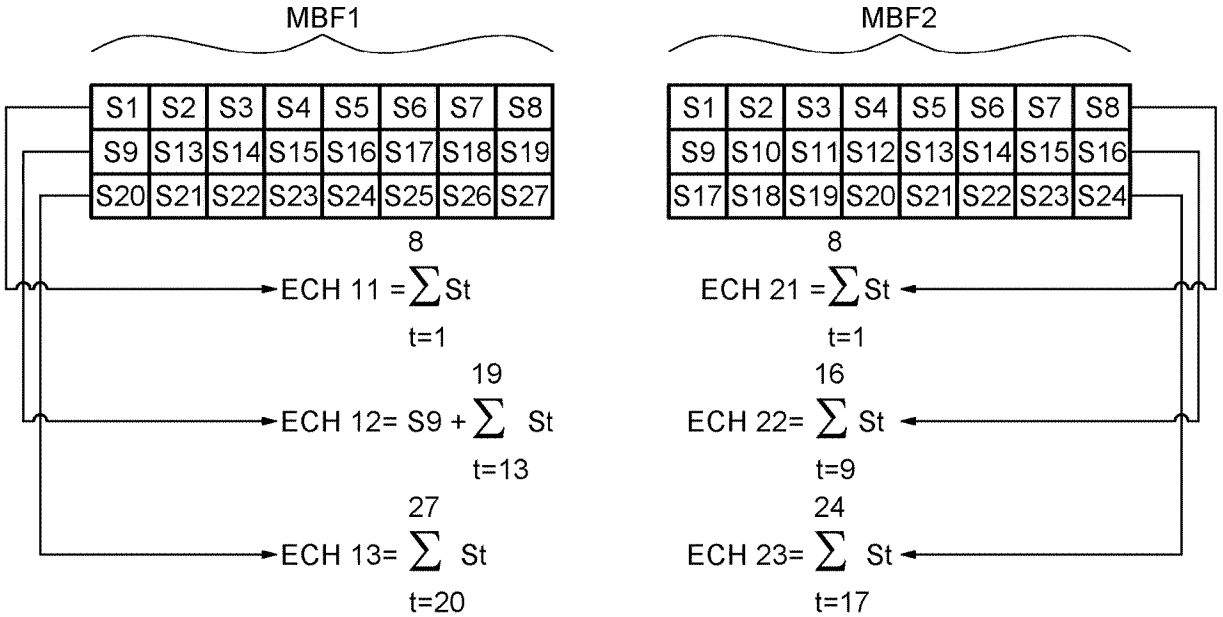

We refer now more particularly to FIG. 5 and to FIG. 6 for illustrating an embodiment of a method.

For simplification, the presented example takes the assumption that the decimation factor M is equal to 8. So, a PCM sample ECH will be built from 8 samples (8 bits) St belonging to the corresponding first digital stream coming from the microphones.

In this example, we assume there are only two microphones MIC1 and MIC2.

The two upper lines of FIG. 5 show the samples St (t is the temporal index corresponding to the current clock pulse of the first clock signal CLK1) of the streams coming from MIC1 (left) and MIC2 (right) without delay.

The two lower lines of FIG. 5 show an example where a delay has been added during the reception of the $10^{th}$ PDM sample.

In this example, three samples coming from MIC1 have been skipped (i.e. the samples S10, S11 and S12).

The left part of FIG. 6 shows the content of the memory buffer MBF1 located within the decimation filter 150 and containing successively three groups of 8 PDM samples St issued from MIC1 and permitting the calculation of three successive PCM samples ECH11-ECH13.

In this example, for simplicity, the low pass filter 13 has been reduced to its simplest expression, i.e. a simple accumulator.

The right part of FIG. 6 shows the content of the memory buffer MBF2 located within the decimation filter 150 and containing successively three groups of 8 PDM samples St issued from MIC2 permitting to calculate the three successive PCM samples ECH21-ECH23.

It can be seen that the third PCM sample ECH13 for the left channel is obtained from the PDM samples S20-S27 while the third PCM sample ECH23 of the right channel is obtained from the PDM samples S17-S24.

Accordingly, the right channel has been delayed by three PDM samples versus the left channel.

The process is not limited to a one dimensional array of microphones, but could also apply when the plurality of digital microphones form a two-dimensional array, having for example a first group of first digital microphones aligned in a first direction and a second group of second digital microphones in a second direction, perpendicular to the first direction.

In such an arrangement, the computing module of the processing unit determines a first group of delays for aligning samples of the bitstreams produced by a same wave front travelling in a direction of propagation and incident upon the first group of digital microphones, and a second group of delays for aligning samples of the bitstreams produced by the same wave front incident upon the second group of digital microphones. The direction of propagation of the wave front is thus selected as preferential direction of reception both for the first digital microphones and for the second digital microphones.

The processing unit applies the first group of delays to the first group of bitstreams and the second group of delays to the second group of bitstreams through corresponding skipping modules as already described. After PDM-to-PCM conversion by low-pass filtering and decimation first audio signals and second audio signals are provided. The first audio signals and the second audio signals are all added by the adder, which supplies the synthetic audio signal in which the contributions supplied both by the first digital microphones and by the second digital microphones and due to acoustic signals coming from the preferential direction of reception are amplified, unlike the other contributions.

Figure 7:
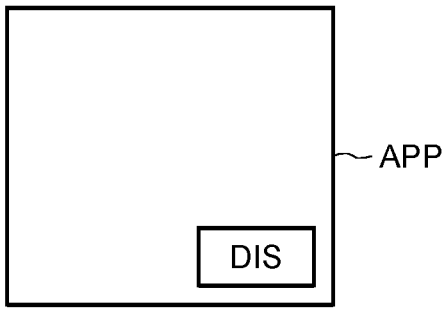
FIG. 7 is a block diagram of an apparatus including the device.

As illustrated on FIG. 7, an apparatus APP is also proposed containing a device DIS as disclosed above.

Such an apparatus may be for example a phone, a smartphone, a tablet, a phablet, a wearable device or a plugged system such as a conference phone, these examples being in no way limiting.

The invention is not limited to the above disclosed embodiments.

As a matter of fact, while examples involving acoustic signals have been disclosed, the invention applies also for other signals representative of physical entities.

More particularly possible applications of the invention are the ones using low frequency waves such as sound, ultrasound, low-speed electrical signals.

On can cite, for example, sonar applications (in air or in water) to locate the source of sound/ultrasound. Delay lines can be used to find maximum correlation between different streams, and then be able to locate the sound source. Pulse skipper allows a good precision on time-of arrival delays without strong processing.

Gesture recognition using ultrasound signals can be also an interesting application of the invention.

Among other possible signals representative of physical entities, one can cite nerve signals in medical applications having a speed between around 20 m/s and 100 m/s, or more generally electrical signals for which the pulse skipper may allow for example to estimate with a good accuracy the phase between two physical parameters, for example voltage and current, in metering applications.

The invention claimed is:

1. A method, comprising:

receiving first digital streams of first digital samples at a first sampling frequency respectively issued from corresponding initial signals representative of physical entities, converting streams issued from the first digital streams into second digital streams sampled at a second sampling frequency lower than said first sampling frequency, combining the second digital streams to generate an output digital stream, determining at least one delay to be applied to at least one first digital stream to satisfy a condition on said second digital streams, and applying said at least one delay to said at least one first digital stream before converting, wherein said converting comprises filtering said first digital streams with respective decimation filters, each decimation filter being clocked by a first clock signal having said first sampling frequency, and wherein applying said at least one delay to said at least one first digital stream comprises skipping a number of first digital samples in said at least one first digital stream, said number of first digital samples skipped depending on a value of said at least one delay, said skipped first digital samples being not delivered for filtering by the corresponding decimation filter to generate the corresponding second digital stream, and wherein skipping said number of first samples in said at least one first digital stream comprises skipping said number of clock cycles in the corresponding first clock signal clocking said corresponding decimation filter associated to said at least one first digital stream, and wherein skipping said number of clock cycles in said corresponding first clock signal comprises gating said corresponding first clock signal.

2. The method according to claim 1, wherein said initial signals are acoustic signals, said first digital streams of first digital samples are in a Pulse Density Modulation (PDM) format, said second digital streams are audio signals in a Pulse Code Modulation (PCM) format.

3. The method according to claim 1, wherein the second digital streams are audio signals and said condition is an alignment of said audio signals in accordance with a beamforming algorithm.

4. A device, comprising:

an input configured to receive first digital streams of first digital samples at a first sampling frequency respectively issued from corresponding initial signals representative of physical entities;

a conversion circuit configured to convert streams issued from the first digital streams into second digital streams sampled at a second sampling frequency lower than said first sampling frequency, said conversion circuit comprising decimation filters respectively associated to said first digital streams;

a summation circuit configured to combine the second digital streams to generate an output digital stream;

a delay circuit coupled between said input and said conversion circuit and configured to apply at least one delay to at least one first digital stream, said delay circuit comprising skipping circuits configured to skip a number of first digital samples of the first digital streams in response to control information; and a control circuit configured to determine said at least one delay to be applied to said at least one first digital stream to satisfy a condition on said second digital streams, said control circuit delivering the control information to said skipping circuits, said control information including a value of the number of first digital samples to skip in each first digital stream, the value of said number depending on the value of said at least one delay, said skipped first digital samples being not delivered to the corresponding decimation filter to generate the corresponding second digital stream;

wherein each decimation filter is clocked by a first clock signal having said first sampling frequency and each skipping circuit is configured to skip said number of clock cycles in the corresponding first clock signal clocking said corresponding decimation filter associated to said at least one first digital stream; and wherein each skipping circuit comprises a gating circuit configured to receive said first clock signal and said control information and to deliver a gated first clock signal to the corresponding decimation filter.

5. The device according to claim 4, wherein the control information further comprises a trigger signal.

6. The device according to claim 4, wherein said gating circuit comprises:

a counter clocked by said first clock signal and controlled by a trigger signal to receive said value and to deliver a control gate signal having a first logic value when the trigger signal has a value corresponding to a non-skipping mode, and a second logic value when the trigger signal has a value corresponding to a skipping mode and until the counter has counted a number of first clock cycles equal to the value of the number of first digital samples to skip; and a logic gate configured to receive said first clock signal and said control gate signal and to deliver said gated first clock signal having no clock pulses when said control gate signal has said second logic value.

7. The device according to claim 4, comprising:

a microprocessor or a microcontroller incorporating said control unit implemented by software, and hardware circuits around said microprocessor or microcontroller incorporating said decimation filters.

8. The device according to claim 4, wherein said initial signals are acoustic signals, said first digital streams of first digital samples are in Pulse Density Modulation (PDM) format, said second digital streams are audio signals in Pulse Code Modulation (PCM) format.

9. The device according to claim 4, wherein said second digital streams are audio signals and wherein said condition is an alignment of said audio signals in accordance with a beam forming algorithm.

10. The device according to claim 9, further comprising an array of digital microphones coupled to said input and configured to supply said first digital streams in response to acoustic signals.

11. The device according to claim 10, wherein said microphones are MEMS microphones.

12. The device according to claim 4, wherein the device is incorporated within an apparatus.

13. The device according to claim 12, wherein the apparatus is selected from a group consisting of: a phone, a smartphone, a tablet, a phablet, a wearable device, and/or a plugged system, such as a conference phone.

14. A method, comprising:

receiving a first digital stream of digital samples;

receiving a second digital stream of digital samples;

determining first and second delays to be applied to the first and second digital streams, respectively, to satisfy a beamforming condition;

skipping digital samples of the first digital stream to implement the determined first delay of the first digital stream and generate a first sample skipped digital stream;

skipping digital samples of the second digital stream to implement the determined second delay of the second digital stream and generate a second sample skipped digital stream;

wherein skipping comprises blocking a number of clock cycles in a clock signal corresponding to a number of digital samples to be skipped;

decimation filtering of the first sample skipped digital stream to produce a first decimated digital stream;

decimation filtering of the second sample skipped digital stream to produce a second decimated digital stream;

wherein decimation filtering is performed in response to the clock signal at a frequency equal to a sampling frequency of the first and second digital streams; and summing the first and second decimated digital streams to generate an output digital stream.

15. A device, comprising:

a first input configured to receive a first digital stream of digital samples;

a second input configured to receive a second digital stream of digital samples;

a processing circuit configured to determine first and second delays to be applied to the first and second digital streams, respectively, to satisfy a beamforming condition;

a first skipping circuit configured to skip digital samples of the first digital stream to implement the determined first delay of the first digital stream and generate a first sample skipped digital stream;

a second skipping circuit configured to skip digital samples of the second digital stream to implement the determined second delay of the second digital stream and generate a second sample skipped digital stream;

wherein each first and second skipping circuit operates to block a number of clock cycles in a clock signal corresponding to a number of digital samples to be skipped;

a first decimation filter configured to filter the first sample skipped digital stream to produce a first decimated digital stream;

a second decimation filter configured to filter the second sample skipped digital stream to produce a second decimated digital stream;

wherein each first and second decimation filter is clocked by the clock signal at a frequency equal to a sampling frequency of the first and second digital streams; and a summation circuit configured to sum the first and second decimated digital streams to generate an output digital stream.

* * * * *